US006507721B1

(12) United States Patent
Yergenson et al.

(10) Patent No.: US 6,507,721 B1
(45) Date of Patent: Jan. 14, 2003

(54) TONER RESUPPLY ROLLER WITH SKEWED RIBS

(75) Inventors: Robin P. Yergenson, Eagle, ID (US); David W. Boyd, Greeley, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/135,943

(22) Filed: Apr. 29, 2002

(51) Int. Cl.[7] ..... G03G 15/08

(52) U.S. Cl. ..... 399/281

(58) Field of Search ..... 399/272, 281, 399/282; 492/18, 48

(56) References Cited

U.S. PATENT DOCUMENTS 5,854,961 A * 12/1998 Wibbels et al. ..... 399/281
6,026,265 A * 2/2000 Kinoshita et al. ..... 399/281
6,149,564 A * 11/2000 Nozawa et al. ..... 399/281 X
6,196,958 B1 * 3/2001 Shiraki et al. ..... 399/281 X

* cited by examiner

*Primary Examiner*—Joan Pendegrass
*Assistant Examiner*—Candice C. Campbell
(74) *Attorney, Agent, or Firm*—David W. Boyd

(57) ABSTRACT

A toner resupply roller in a laser printer has ribs that are not parallel to the rotational axis of the roller. The ribs form a tilted, helical, herringbone, or other pattern on the roller. The nonparallel ribs may serve to reduce vibrations introduced into the printer mechanism, and to distribute toner in such a way as to reduce banding in printed materials.

3 Claims, 4 Drawing Sheets

TONER RESUPPLY ROLLER WITH SKEWED RIBS

FIELD OF THE INVENTION

The present invention relates generally to laser printing.

BACKGROUND OF THE INVENTION

FIG. 1 depicts a cross-section view of a typical laser printer 100. During operation of the printer, a substantially uniform charge is placed on the surface of drum 101 by charge roller 102, or alternatively, by a corona wire. Laser beam 103, controlled by a steering mechanism represented by mirror 112, selectively illuminates areas of drum 101. This illumination at least partially discharges those areas of drum 101, for example by photoconduction to a conductive substrate in the drum. The selective discharging of areas on drum 101 forms a latent image on drum 101.

FIG. 2 shows a magnified view of the resupply roller region of FIG. 1. Particles of toner 104 carrying an electric charge are taken from a toner supply container 105 by resupply roller 106 and deposited on the surface of developer sleeve 107. Developer sleeve 107 is depicted as a cylinder in this example printer, but other printers may use other toner receiving surfaces. For example, the toner may be received onto a belt. A leveling blade 113 may assist with the distribution of toner on developer sleeve 107.

Developer sleeve 107 carries a voltage bias such that when the toner-coated developer sleeve 107 makes rolling contact with drum 101, the charged toner particles are attracted to the discharged areas on drum 101, and repelled from the still-charged areas on drum 101. In this way, toner is collected on selected portions of the surface of drum 101, forming an image in toner 110 on the drum surface.

As drum 101 rotates further, the toner image 110 is brought into rolling contact with paper 108 between drum 101 and transfer roller 109. Transfer roller 109 carries a voltage bias such that the charged toner particles are strongly attracted to it, and thus pulled from the surface of drum 101 onto the surface of paper 108. The toner image 110 is thus transferred to the surface of paper 108.

The paper, carrying the toner image, then passes through a fuser mechanism 111. The fuser mechanism 111 may consist of one or more heated rollers that briefly melt the toner particles, fusing them to paper 108. After passing through the fuser mechanism, paper 108 carries a substantially permanent image.

It is the object of resupply roller 106 to coat developer sleeve 107 with a layer of toner particles. The resupply roller 106 may have longitudinal ribs for assisting in the mechanical transfer of toner 104 to developer sleeve 107.

While the ribs may greatly facilitate the movement of toner 104 to developer sleeve 107, they may also affect the quality of the image eventually produced on paper 108. The mechanical interaction of the ribs with developer sleeve 107 may excite minute vibrations in the printer mechanism, or the toner may not be placed on developer sleeve 107 with perfect uniformity. These effects may cause banding in the final printed image, especially when the image being printed is a photograph or other graphical element.

There is a need for an improvement to the resupply roller so that image artifacts are reduced.

SUMMARY OF THE INVENTION

A toner resupply roller in a laser printer has ribs that are not parallel to the rotational axis of the roller. The ribs form a tilted, helical, herringbone, or other pattern on the roller.

DETAILED DESCRIPTION OF THE PREFERRED EMBODIMENT

Figure 1:
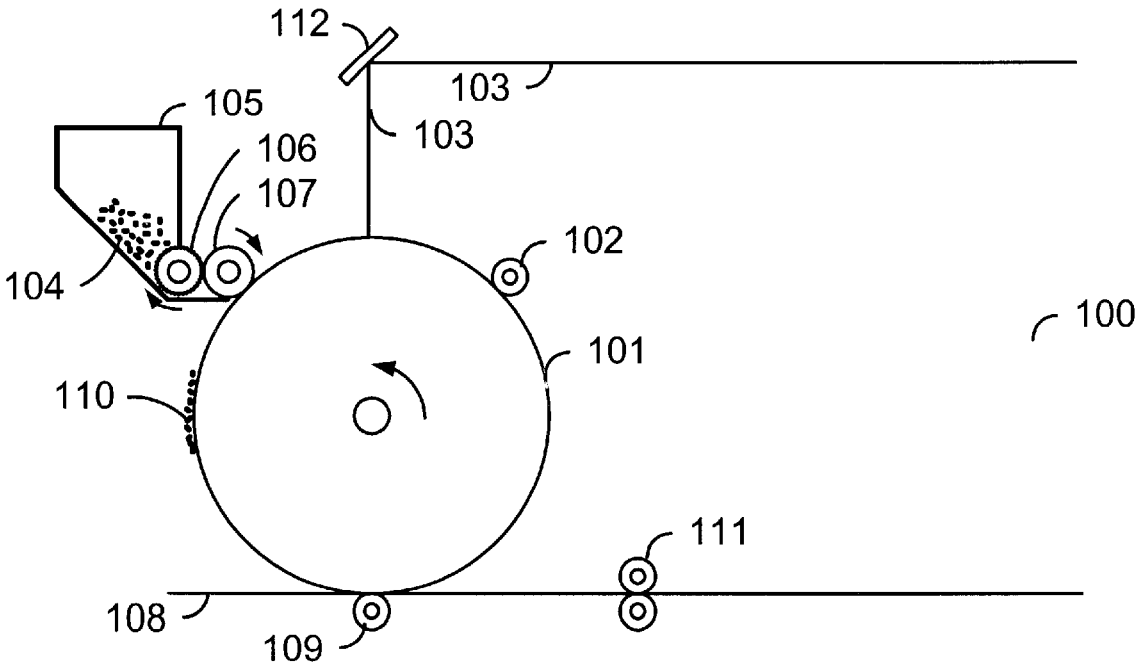
FIG. 1 is a simplified cross section diagram of a typical laser printer.
Figure 2:
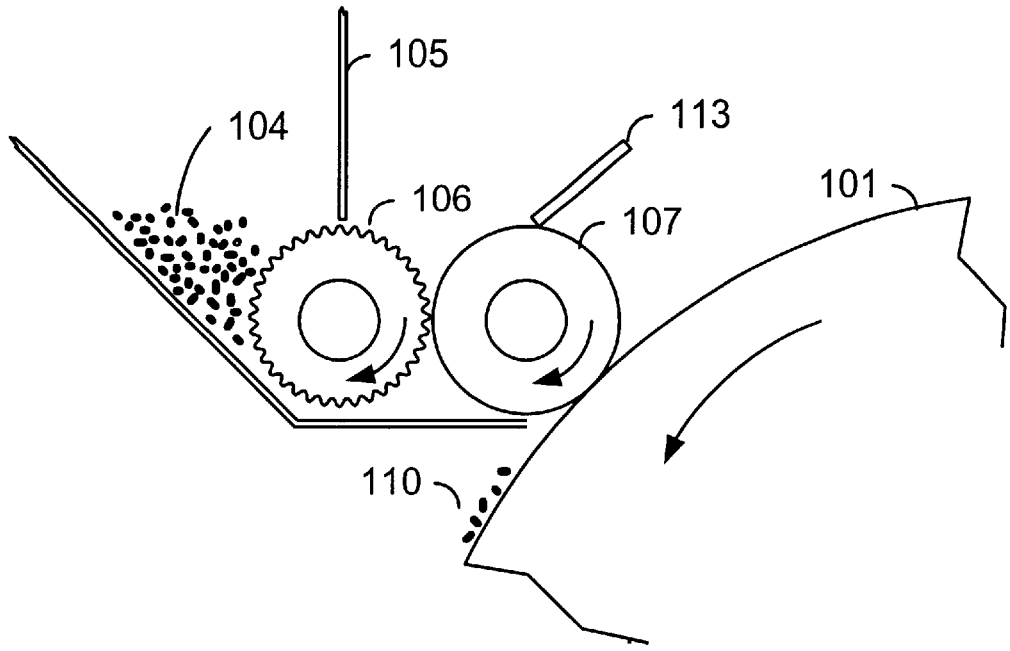
FIG. 2 shows a magnified view of the resupply roller region of FIG. 1.
Figure 3:
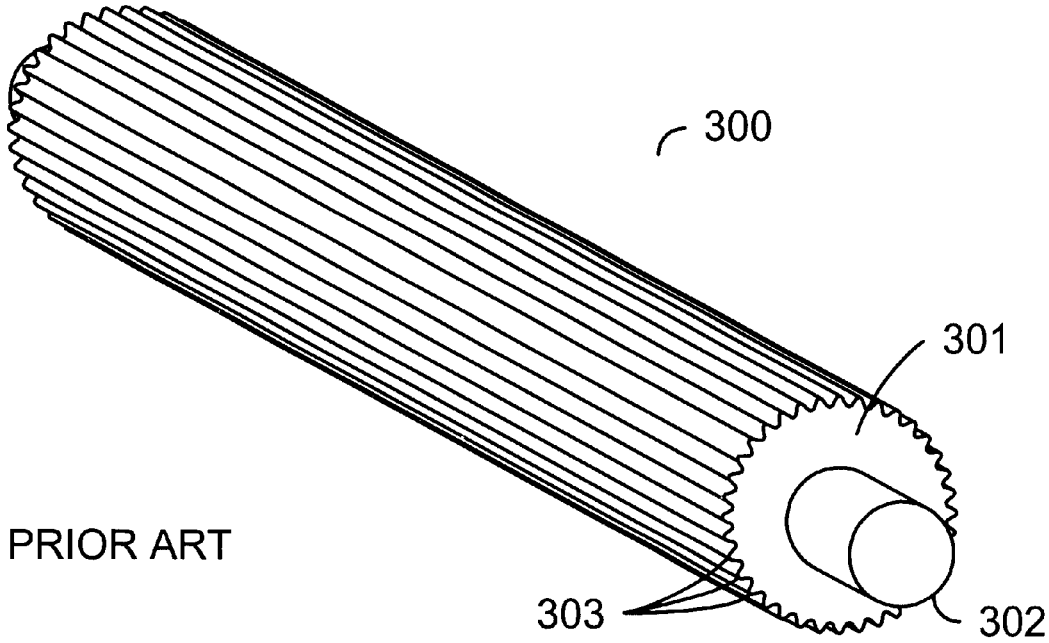
FIG. 3 shows a perspective view of a prior art resupply roller.

FIG. 3 shows a perspective view of a prior art resupply roller. The main body 301 of the roller is generally cylindrical and may be made of a urethane foam or other compliant material. The compliant roller body 301 may be adhered to a shaft 20 302 made of steel, some other metal, or some other sufficiently strong material. Shaft 302 may also comprise one or more driving components such as a gear, pulley, capstan, knurl, or other features.

The roller body 301 comprises a number of ribs around its circumference, of which ribs 303 are representative. The ribs facilitate the transfer of toner 104 to the developer sleeve 107. It is the object of resupply roller 300 to deposit a substantially uniform layer of toner 104 onto developer sleeve 107. The ribs 303 in prior art resupply roller 300 are parallel to the rotational axis of the roller.

In their interaction with the developer sleeve, the prior art ribs 303 may excite small mechanical vibrations in the mechanism of printer 100. The ribs may also result in a nonuniform distribution or toner around the developer sleeve 107. Either of these effects may detrimentally affect the quality of the image produced by printer 100. Some banding in the image may be traced to the ribs 303 on roller 300. Banding in an image is a reflectance variation, usually having a one-dimensional characteristic, often horizontal or vertical on the resulting page. For example, a printed area of nominal uniform density may show a pattern of horizontal darkened areas, or "bands," interspersed with horizontal lightened bands. Banding may be cyclic or non-cyclic.

Figure 4:
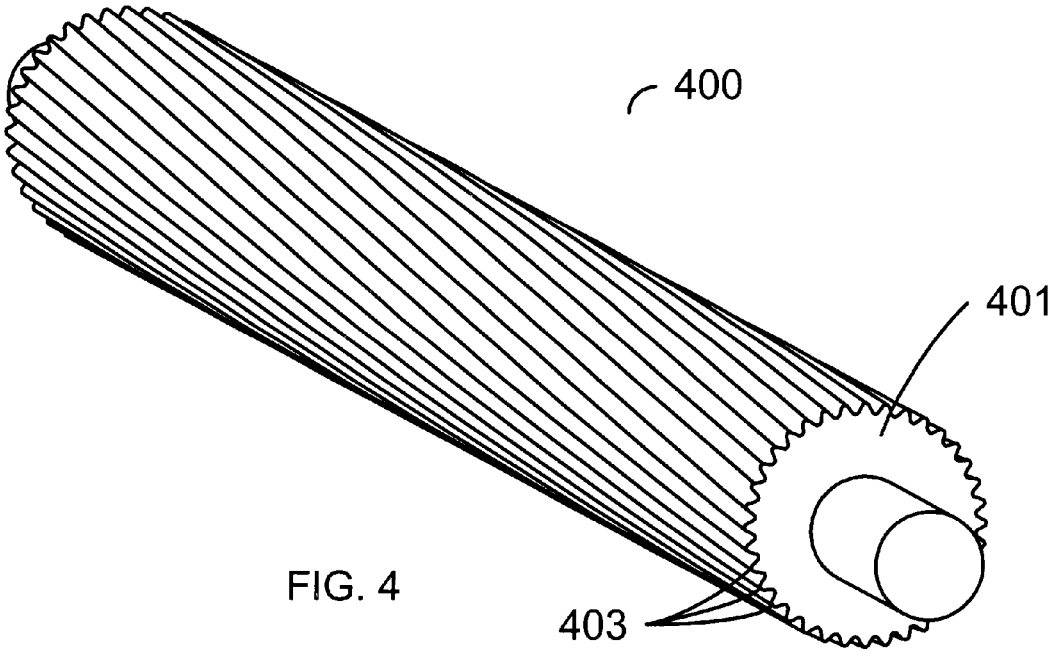
FIG. 4 shows a perspective view of an example embodiment of a resupply roller according to the present invention.

FIG. 4 shows a perspective view of an example embodiment of a resupply roller 400 according to the present invention. The roller is made of similar materials as prior art roller 300, and may comprise similar driving components.

The roller body 401 comprises a number of ribs around its circumference, of which ribs 403 are representative. The ribs facilitate the transfer of toner 104 to the developer sleeve 107. It is the object of resupply roller 400 to deposit a substantially uniform layer of toner 104 onto developer sleeve 107, and to do so in such a way as to avoid introducing objectionable artifacts into the resulting image produced by the printer 100.

The ribs on resupply roller 400 are not parallel to the rotational axis of the roller. A tilt is introduced, such that the ribs form a substantially helical pattern on roller 400. That is, each rib traverses the circumference of the roller 400 in direct relation to the distance that it extends along the length of the roller 400. If the circumferential traverse of the rib is constantly proportional to its extent along the length of the roller, then the roller forms a helix. For the purposes of this disclosure, a substantially helical pattern is one that has the character of a helix, but need not be mathematically an exact helix.

The tilt angle for the ribs on roller 400 is sufficiently large that several ribs are in the vicinity of the pinch line between roller 400 and developer sleeve 107 at any particular time. This arrangement may serve to reduce the vibrations introduced into the printer mechanism, and may thereby reduce banding in printed images. It may be desirable to keep the tilt angle small to avoid "pumping" toner from one end of roller 400 to the other. FIG. 4 depicts a helix angle of approximately 2.6 degrees on a roller 228 millimeters long. Of course, other tilt angles are possible.

In addition, the tilted ribs may serve to reduce the objectionable nature of any residual banding. Any nonuniformity of toner distribution on developer sleeve 107 produced by roller 400 will be nonparallel to the developer sleeve 107 rotational axis, and thus any resulting image artifacts will not be perfectly horizontal on the page. This may serve to reduce the noticeability of any residual artifacts. There may be other sources of horizontal banding in a printer. The skewed ribs of roller 400 may serve to reduce the banding contribution from the resupply roller, or to disrupt and reduce banding from other sources.

Figure 5:
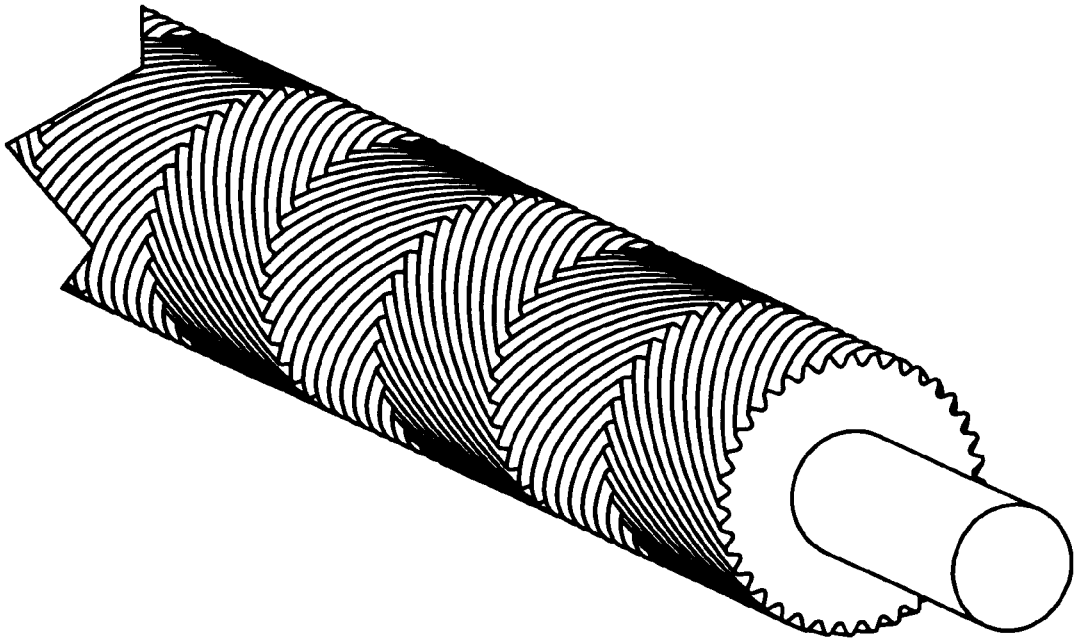
FIG. 5 shows a partial view of an alternative example embodiment of a resupply roller according to the present invention.

Other arrangements are possible for providing ribs nonparallel to the rotational axis of a resupply roller. For example, FIG. 5 shows an alternative example embodiment of a resupply roller according to the present invention. In this example embodiment, the ribs form a "herringbone" pattern on the roller. A herringbone pattern comprises alternating segments of substantially helical rib patterns, each segment having a helix angle of opposite sign compared with the neighboring segments. This pattern may reduce the tendency of the roller to transport toner along its length.

Figure 6:
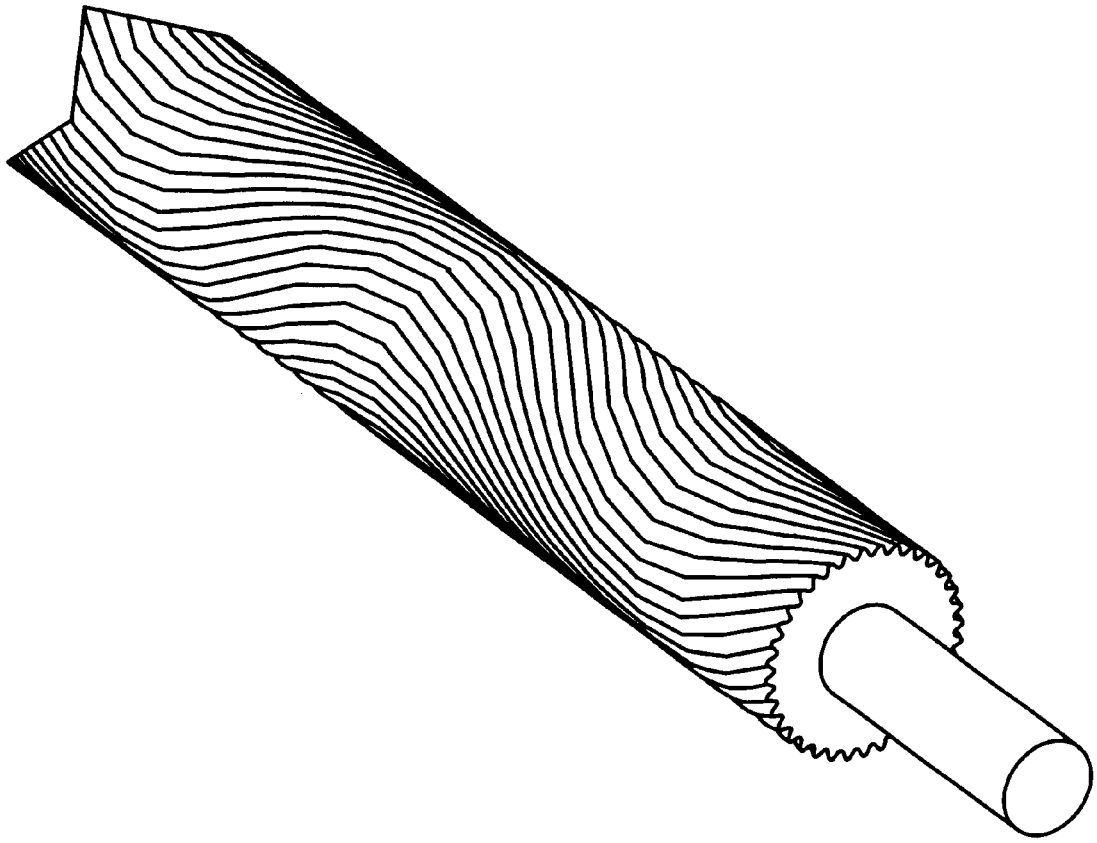
FIG. 6 shows a partial view of an additional example embodiment of a resupply roller according to the present invention.

Additionally, FIG. 6 shows a pattern wherein each rib traverses the circumference of the roller in an amount that oscillates in relation to the distance the rib extends along the length of the roller. For the purposes of this disclosure, oscillation means that a particular rib repeatedly crosses a line on the roller surface parallel to the rotational axis of the roller. The oscillation may be sinusoidal, otherwise repetitive, or non-repetitive.

The foregoing description of the present invention has been presented for purposes of illustration and description. It is not intended to be exhaustive or to limit the invention to the precise form disclosed, and other modifications and variations may be possible in light of the above teachings. For example, the resupply roller could be constructed of other materials, or other rib patterns could be envisioned wherein the ribs are nonparallel to the rotational axis of the roller. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A toner resupply assembly for a laser printer comprising:

a) a generally-cylindrical resupply roller having an outer surface;

b) a rotational axis of the resupply roller;

c) a toner receiving surface adjacent the resupply roller; and d) ribs disposed on an outer surface of the resupply roller, the ribs disposed nonparallel to the rotational axis, the roller rotating and depositing toner on the toner receiving surface, and wherein the ribs form a herringbone pattern on the roller.

2. A method of moving toner in a laser printer comprising the steps of:

a) providing a resupply roller, the resupply roller being generally cylindrical and having an axis of rotation, the roller comprising ribs on an outer surface, the ribs being nonparallel to the axis of rotation and forming a herringbone pattern on the outer surface of the roller; and b) rotating the resupply roller at least partially within a supply of toner, the resupply roller thereby carrying toner to be deposited elsewhere.

3. A printer comprising:

a) a supply of toner;

b) a resupply roller, the resupply roller being generally cylindrical and having an axis of rotation, the roller comprising ribs on an outer surface, the ribs being nonparallel to the axis of rotation and forming a herringbone pattern on the outer surface of the roller; and wherein the resupply roller rotates at least partially within the supply of toner, transporting toner to be deposited onto a toner receiving surface.

* * * * *